US011833523B2

(12) United States Patent
Fuchs et al.

(10) Patent No.: US 11,833,523 B2
(45) Date of Patent: Dec. 5, 2023

(54) FLUIDIZED BED OPPOSED JET MILL FOR PRODUCING ULTRAFINE PARTICLES FROM FEED MATERIAL OF A LOW BULK DENSITY AND A PROCESS FOR USE THEREOF

(71) Applicant: HOSOKAWA ALPINE Aktiengesellschaft, Augsburg (DE)

(72) Inventors: Tobias Fuchs, Neusäß (DE); Michael Müller, Essingen (DE); Bernhard Renner, Augsburg (DE)

(73) Assignee: HOSOKAWA ALPINE Aktiengesellschaft, Augsburg (DE)

( * ) Notice: Subject to any disclaimer, the term of this patent is extended or adjusted under 35 U.S.C. 154(b) by 70 days.

(21) Appl. No.: 17/490,106

(22) Filed: Sep. 30, 2021

(65) Prior Publication Data

US 2022/0105520 A1 Apr. 7, 2022

(30) Foreign Application Priority Data

Oct. 1, 2020 (DE) ..... 10 2020 006 008.0

(51) Int. Cl.
*B02C 19/00* (2006.01)
*B02C 19/06* (2006.01)

(52) U.S. Cl.
CPC ..... *B02C 19/068* (2013.01)

(58) Field of Classification Search
CPC ..... B02C 19/065; B02C 19/068
See application file for complete search history.

(56) References Cited

U.S. PATENT DOCUMENTS 1,948,609 A * 2/1934 Andrews ..... B02C 19/068 241/39
3,493,184 A * 2/1970 Horrocks ..... B01J 8/1818 241/40

(Continued)

FOREIGN PATENT DOCUMENTS

CN 101433876 A 5/2009
CN 201475991 U 5/2010

(Continued)

OTHER PUBLICATIONS

For Korean Patent Application No. 10-2021-0126422: Notification of Grounds for Refusal, dated Dec. 5, 2022.

(Continued)

*Primary Examiner* — Faye Francis
(74) *Attorney, Agent, or Firm* — Paul D. Bianco; Katharine Davis Wong; Fleit Intellectual Property Law

(57) ABSTRACT

In consideration of increasing throughput rate of a stable operating process as well as making the process energy-efficient, the aim is to optimise a fluidised bed opposed jet mill and a dedicated process to produce ultrafine particles from a feed material of low bulk density with a housing in vertical design, with a product feed point and a product discharge, with a grinding zone located in the lower area of the housing which has grinding nozzles spaced evenly around the circumference whose jets intersect at one central point and with a classifying device installed in the upper area of the housing. This is achieved by the feed material dosed to the mill from the bottom into the mill sump as a gas-particle mixture, whereby a deflector hood is located above the feed point and below the grinding nozzle level, and the grinding gas nozzles designed to be flush with the walls.

12 Claims, 1 Drawing Sheet

(56) References Cited

U.S. PATENT DOCUMENTS

| | | | | |
|---|---|---|---|---|
| 3,734,413 | A * | 5/1973 | Kaiser | B02C 23/12 241/39 |
| 4,018,388 | A | 4/1977 | Andrews | |
| 4,133,488 | A | 1/1979 | Heinemann | |
| 4,538,764 | A * | 9/1985 | Dunbar | B02C 19/065 241/39 |
| 4,602,743 | A | 7/1986 | Nied | |
| 4,905,918 | A * | 3/1990 | Selles | B02C 19/068 241/39 |
| 5,716,751 | A * | 2/1998 | Bertrand | G03G 9/0804 241/15 |
| 5,992,773 | A | 11/1999 | Schwechten | |
| 6,224,004 | B1 * | 5/2001 | Kato | B02C 19/065 241/39 |
| 6,398,139 | B1 | 6/2002 | Nied | |
| 6,543,710 | B2 | 4/2003 | Hosokawa | |
| 7,850,102 | B2 | 12/2010 | Meier et al. | |
| 8,039,105 | B2 | 10/2011 | Meier et al. | |
| 10,052,799 | B2 | 8/2018 | Bayer | |
| 10,252,298 | B2 | 4/2019 | Knauer et al. | |
| 2015/0239048 | A1 | 8/2015 | Nagata | |
| 2022/0105520 | A1 | 4/2022 | Fuchs | |

FOREIGN PATENT DOCUMENTS

| | | | |
|---|---|---|---|
| CN | 202527251 | U | 11/2012 |
| CN | 203355834 | U | 12/2013 |
| CN | 105107595 | A | 12/2015 |
| CN | 202983812 | U | 6/2016 |
| CN | 206152933 | U | 5/2017 |
| CN | 206276477 | U | 6/2017 |
| CN | 107051682 | A | 8/2017 |
| CN | 208526909 | U | 2/2019 |
| CN | 208554513 | U | 3/2019 |
| CN | 209531095 | U | 10/2019 |
| CN | 114273043 | B | 4/2023 |
| DE | 31 40 294 | A1 | 4/1983 |
| DE | 3140294 | A1 | 4/1983 |
| DE | 3338138 | A1 | 5/1985 |
| DE | 10045160 | A1 | 5/1985 |
| DE | 4100338 | A1 | 7/1992 |
| DE | 197 28 382 | A1 | 1/1999 |
| DE | 198 40 344 | A1 | 5/2000 |
| DE | 10 2006 048 850 | A1 | 4/2008 |
| DE | 10 2020 006008 | B3 | 3/2022 |
| EP | 0139279 | A2 | 5/1985 |
| JP | 2227148 | A | 9/1990 |
| JP | 03-213161 | A | 9/1991 |
| JP | 161257 | | 6/1992 |
| JP | 2528348 | B | 8/1996 |
| JP | 10-020557 | A | 1/1998 |
| JP | 2007-264315 | A | 10/2007 |

OTHER PUBLICATIONS

For German Patent Application No. 10 2020 006 008.0: Office Action dated Sep. 15, 2021.

For European Patent Application No. 21000257.2: Office Action dated Mar. 24, 2022.

For Chinese Patent Application No. 202111149659.X: Notification of the First Office Action dated Oct. 19, 2022.

* cited by examiner

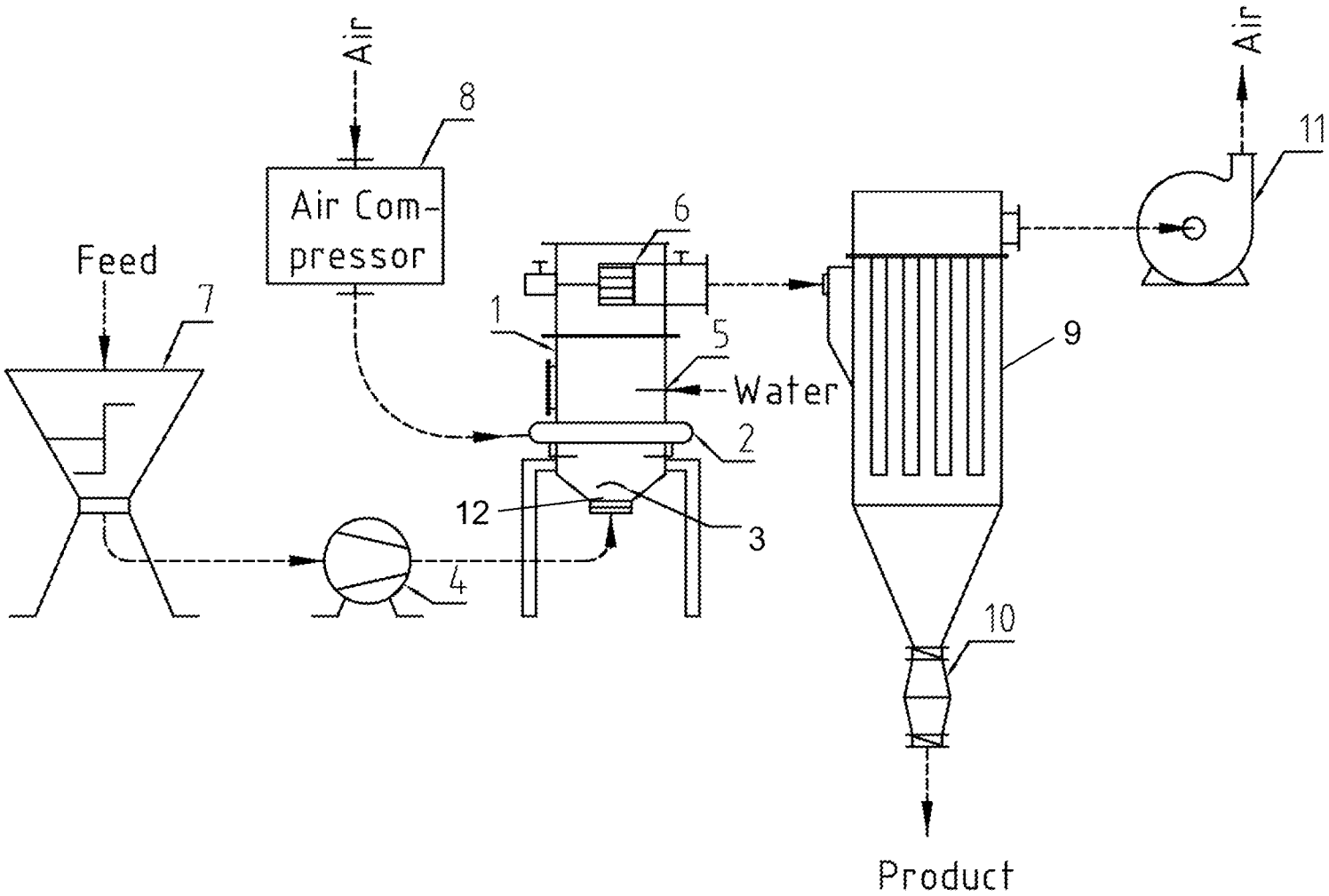
Air
11
9
10
Product
Water
5
2
3
6
1
12
8
Air
Air Com-
pressor
4
7
Feed

FLUIDIZED BED OPPOSED JET MILL FOR PRODUCING ULTRAFINE PARTICLES FROM FEED MATERIAL OF A LOW BULK DENSITY AND A PROCESS FOR USE THEREOF

FIELD OF THE DISCLOSURE

The disclosure relates to fluidised bed opposed jet mills designed as classifier mills and concerns the constructional design of the fluidised bed opposed jet mill as well as a dedicated process.

BACKGROUND

Fluidised bed opposed jet mills consist of a housing with a vertical central axis. Located in the bottom area is a grinding zone in which the product to be processed forms a mill sump. The mill has several grinding nozzles in this area which are evenly distributed around the circumference and which are pressurised with compressed air. The grinding nozzles are directed against each other in such a way that the product in the grinding chamber is sucked into the jets of air, whereby the material particles entering the jets are accelerated and collide with each other in the zone where the jets of air intersect, and are comminuted by the effects of interparticle collision. A classifier is installed above the grinding zone. The classifier is usually designed as a centrifugal-force classifier, whereby particles that are finer than the cut point size are transported inwards into the rotating classifying wheel of the classifier and are separated there, whereas particles that are coarser than the cut point size are rejected by the rotating classifying wheel and remain in the grinding chamber. The feed product is charged to the fluidised bed opposed jet mill preferably from above into the grinding zone.

A fluidised bed opposed jet mill is described in the patent DE 31 40 294 A1. The feed product is dosed into the sump of the mill by a dosing screw.

Patent DE 197 28 382 C2 reveals a fluidised bed opposed jet mill where the jet of grinding gas is accelerated together with part of the feed material before being introduced into the mill sump of the fluidised bed opposed jet mill.

In patent DE 10 2006 048 850 A1, among other things a process to produce amorphous particles is described for which a fluidised bed opposed jet mill is used. The fluidised bed opposed jet mill used in this case is described in the patent EP 0139279. As revealed in patent EP 0139279, conventional fluidised bed opposed jet mills have a product intake above the grinding chamber so that the feed material is charged to the grinding zone from above.

The products processed with fluidised bed opposed jet mills are many and varied. In order to achieve an optimum grinding result, it is not only the grinding process but also the mill itself which is chosen to match the material. In the case of materials of a low bulk density or also materials, whose comminuted products display a low bulk density, the problem is that the particles want to primarily follow the gas flow and hardly form sediments. In the case of a product intake located above the grinding zone, the material accordingly migrates only insufficiently downwards into the grinding zone and is instead presented to the classifying wheel for classification in uncomminuted or undispersed state. The coarse material rejected by the classifying wheel places a high mechanical stress on the classifier and is unable to return to the grinding zone against the upward flow. This causes a strong increase of volume of the product during grinding, which is why the pressure drop across the classifier increases dramatically and the throughput sinks. The lower the bulk density of the product, the stronger this effect. This problem arises, for example, when grinding materials with a bulk density of less than 500 g/cm$^3$ such as silica, but also with perlites or zeolites.

SUMMARY

One aspect of the disclosure therefore is to provide a fluidised bed opposed jet mill and a process to operate a fluidised bed opposed jet mill in order to optimise the production of fine particles from feed material with a low bulk density. This to take place under consideration of an increase to the throughput with a process displaying stable operating characteristics as well as a process that is as energy-efficient as possible.

With the disclosed-design fluidised bed opposed jet mill, the feed material is dosed to the mill at the bottom into the mill sump as a gas-particle mixture, whereby a deflector hood is located above the feed point and below the grinding nozzle level, and the grinding gas nozzles are designed to be flush with the walls.

The disclosed-design dedicated process to operate the fluidised bed opposed jet mill is configured such that the feed material in the form of a gas-particle mixture is dosed into the sump of the fluidised bed opposed jet mill underneath the grinding zone and is deflected into the grinding zone by means of a deflector hood located above the feed point.

By combining the characteristic features of both the device and the process, it was possible to significantly optimise the production of fine particles from a feed material of low bulk density using fluidised bed opposed jet mills compared with the state of the art regarding the throughput and the process stability at simultaneously good energy efficiency levels.

To his surprise, the inventor established in tests that by dosing the feed material from below into the mill sump of the fluidised bed opposed jet mill, it was possible to achieve a considerably higher throughput than by dosing the feed material from the side—above the grinding nozzles—into the grinding zone. By dosing the feed material into the mill sump, it is forced to pass through the grinding zone and is subsequently already comminuted to the target particle size and can pass through the classifying wheel without imposing mechanical stress on the wheel. In this way, the flow pattern of the fluidised bed opposed jet mill is as linear as possible, with no major disruptions from bottom to top in the direction of the vertical central axis of the mill, i.e. in the same direction as the volumetric flow of the gas.

Feed materials of low bulk density such as silica are extremely fluid and therefore difficult to dose using a feed screw. The solution to this problem is accomplished by dosing the fluidised feed material in the form of a gas-particle mixture. To this end, a powder diaphragm pump, for example, is employed with which the feed material is extracted from a silo for instance, and is charged directly to the mill. The dosing process is thus dust-free.

The feed material is supplied to the fluidised bed opposed jet mill as a gas-particle mixture from below into the mill sump, preferably at the lowest point of the mill. There is a risk that particles of feed material pass through the grinding zone without being exposed to any mechanical stress. This can lead to spatter grain in the end product, i.e. oversized and undispersed particles pass through the classifying wheel instead of being rejected. To prevent this unstressed passage through the grinding zone and the spatter grain problem, a deflector hood is arranged just above the feed point into the mill sump and significantly below the grinding nozzles. It prevents the feed product from flooding through the grinding zone but rather routes the feed product into the grinding zone in which the feed material is mechanically stressed in the area where the jets of grinding gas intersect and by the effects of interparticle collision. In its simplest design, the deflector hood is a circular plate of suitable diameter which is fixed significantly below the grinding zone by means of a device perpendicular to the direction of flow and which brakes or deflects the gas-particle mixture supplied by the powder diaphragm pump to the mill sump.

The deflector hood can also be combined with other fixtures in the fluidised bed opposed jet mill.

To his surprise, the inventor established in tests that installing the grinding nozzles flush with the wall is particularly effective for stressing feed material of low bulk density in the grinding zone.

In the case of mechanically stressing the feed material in the grinding zone by means of the grinding jets in order to produce ultrafine particles, this can be either a comminution, disintegration or dispersing process. Within the context of this patent application, the expressions comminution or grinding are always used to also mean disintegration or dispersion.

When stressing feed materials—such as silica—of low bulk density in the grinding zone, this is in fact a dispersion of the material which can be performed especially efficiently in terms of energy at low grinding gas pressure. To this end, simple cylindrical grinding nozzles are employed. Dependent on the feed material to be processed and the requisite grinding pressure, Laval nozzles in various designs are also used.

The grinding jets can also be pulsating jets.

If necessary, water—or another additive—can be injected into the mill underneath the classifying zone to optimise the process. Ideally, the water is injected using two-component nozzles together with air or another gas used for the grinding process directly downstream of the grinding zone either centrally into the grinding chamber or flush with the wall.

The injection of water into the grinding chamber serves to reduce the temperature of the gas-particle mixture. On the one hand, this serves to protect the filter membrane and on the other hand, smaller filters can be employed because the volumetric air flow rate is less due to the change to the air density. Furthermore, a specific increase of the particle weight is achieved. The injection of water is also employed to reduce the electrostatic charging of the material, which in turn improves the discharge out of the machine or filter.

The grinding chamber of fluidised bed opposed jet mill is preferably in cylindrical design, whereby the diameter can vary over the height.

The feed material has a bulk density of less than 500 g/cm$^3$, and preferably below 250 g/cm$^3$. The end product has a bulk density of less than 300 g/cm$^3$, and preferably less than 150 g/cm$^3$, especially preferred is less than 75 g/cm$^3$.

The following feed materials of low bulk density and feed materials where end products of low bulk density are produced can also be processed with the invention-design mill: silica, expanded graphite, rice husk ash, perlite, zeolite and other materials.

The feed material stressed in the fluidised bed opposed jet mill such as silica generates a high product volume flow due to the resultant development of a low bulk density. This effect makes itself noticeable at the classifying wheel with its smaller outlet ports or rather free cross-sectional areas compared with the grinding chamber because a function-related bottleneck forms here and a strong pressure drop develops. Over and above this, a co-rotating cloud of particles forms around the classifying wheel, particles which have not yet been ground to the target fineness.

To mitigate this effect, a classifying wheel with a particularly large surface area, i.e. free cross-sectional area, must be used. The classifying wheel has an L/D ratio of >1, preferably of between 1.2 and 1.3, whereby D is the classifying wheel diameter and L the height relevant for the classification (in the direction of the classifying wheel central axis) of the flow channels which are delimited by the classifying wheel vanes as well as the bottom and top cover disc of the classifying wheel.

Moreover, a classifying wheel as described in patent DE 198 40 344 A1 is used. These classifying wheels can be employed at low classifying wheel speeds. Both effects (large free cross-sectional area of the classifying wheel and the low speed) together serve to reduce the resultant pressure drop, which makes realisation of a higher throughput possible.

When processing feed materials of low bulk density or feed materials where products of low bulk density are produced such as silica, a strong pressure drop results due to the product cloud—especially around the classifying wheel. Under application of a fan with a high pressure rating, it is possible to overcome this pressure drop and the throughput increases. Selection of a one-stage fan represents an economically justifiable expenditure.

As a result of the adopted constructive measures described above with respect to the invention-design fluidised bed opposed jet mill, it was possible to dramatically increase the throughput of identically sized machines compared with the state of the art.

For the disclosed-design process to operate the described fluidised bed opposed jet mill, the feed material in the form of a gas-particle mixture is dosed into the sump of the fluidised bed opposed jet mill underneath the grinding zone and is deflected into the grinding zone by means of a deflector hood (3) located above the feed point.

The pressure drop along the grinding gas flow path from the grinding nozzles across the classifying wheel to the filter and fan is a key figure of the process to produce fine particles with a fluidised bed opposed jet mill of feed materials and/or end products of low bulk density such as silica, and is therefore an ideal command variable of the dosing capacity for stable operation. Adjustment of the dosing capacity as a function of the material's weight in the grinding chamber is not possible with these products due to their low bulk density, and applying the power consumption in frequency converter operation to monitor the mechanical stress on the classifying wheel is actually not viable in practice.

Controlling the dosing capacity as a function of the pressure drop is performed as follows: to determine the pressure drop, the relative pressure in the processing chamber in relation to the environment is measured and kept at a constant level by regulating the fan speed. At the same time, a second relative pressure measurement is carried out in the supply line to the filter or on the raw gas side of the filter. The differential pressure between the first and second relative pressure measurement is kept constant as a function of the dosing rate. As an alternative, a differential pressure gauge can be employed.

For an efficient grinding process, an efficient generation of the grinding gas is important, and the energy efficiency is improved by doing without cooling or heating devices. The process therefore operates at the temperature which develops at the air generator during compression.

The preferred type of grinding gas is compressed air, although industrial gases such as hydrogen, noble gases or superheated steam can also be used.

In the production of ultrafine particles from feed materials of low bulk density, the type of mechanical stress in the fluidised bed opposed jet mill is mainly a disintegration or dispersion process; the feed material aggregates can be broken up at low jet power. Because of this, low grinding gas pressures are sufficient for the process and their generation is simultaneously more efficient. Besides this, expensive screw-type compressors are not needed. At pressures of up to 1 bar (g), rotary piston fans can be employed, whereas rotary piston compressors can be used for pressures up to 1.5 bar (g). If the grinding pressure is between 1.5 bar (g) and 3 bar (g), single-stage screw-type compressors are used.

The volume of grinding gas also has a strong influence on the pressure drop in the machine, especially across the classifying wheel, and must therefore be optimised. Too high an air flow rate leads to a high pressure drop, whereas too little reduces the throughput.

If required, water can be injected into the grinding chamber. The following objectives can thus be achieved:

- Reduction of the temperature of the gas-particle mixture, which on the one hand serves to protect the filter membrane in the downstream filter and on the other hand, reduction of the volumetric gas flow rate due to the change in air density.
- Increase of the specific weight of the material.
- Reduction of the electrostatic charging of the material, as the result of which the material discharge is better.

A filter downstream of the fluidised bed opposed jet mill collects and separates the fines. A flow direction in the filter from below would substantially hinder the discharge of the comminuted and extremely light and voluminous product. For this reason, the flow direction in the filter is from above.

Products of low bulk density follow the gas flow and are themselves too light to sediment, which is why the process and machines are laid out such that no sedimentation against the gas flow is necessary.

Because spatter grain frequently occurs in the production of the ultrafine particles of low bulk density, the rinsing air rate at the gap between the classifying wheel and fines discharge is increased.

A dedusting pressure that is as high as possible effectively prevents an increase of the pressure drop at the filter membranes and makes for a better discharge from the filter. The material gains volume as a result of the processing. For example, bulk densities ranging from 30-70 g/cm$^3$ can be present. Because of this, it must be ensured that the double flap valve is able to discharge the volume of product. This can be ensured by selecting a larger double flap valve or in practical terms—within certain limits—by selecting faster cycle times.

The process is operated under negative pressure. To this end, a fan is employed at the end of the process chain which is responsible for ensuring that a low level of underpressure is maintained in the grinding chamber, the classifier and in the filter, this also being responsible for the product transport from the grinding step to the separation step in the filter. In the case of operation under negative pressure, much higher throughputs can be achieved than with operation under positive pressure. There may be additional costs due to the higher fan performance, but on the other hand a much higher throughput is achieved and the specific energy sinks.

BRIEF DESCRIPTION OF THE DRAWING

Other details, features and advantages of the disclosed subject matter arise from the claims and from the following description of the associated drawing in which a preferred embodiment is shown by way of example.

The Figure shows a fluidised bed opposed jet mill with the disclosed-design features and the disclosed-design process.

DETAILED DESCRIPTION

The housing of the fluidised bed opposed jet mill (1) has a vertical central axis. The grinding chamber and grinding zone are located in the lower area of the housing, and above them, at a defined distance, the classifying zone with the air classifier. The grinding chamber is preferably cylindrical in shape. Two grinding nozzles (2) are arranged around the circumference of the grinding chamber, through which the jets of fluid are injected into the grinding zone to subject the feed material to mechanical stress. The feed material can be comminuted, disintegrated and/or dispersed thereby. A fluidised bed develops here. As the fluid, gases—above all air but also steam—can be employed. The grinding nozzles (2) are spaced uniformly around the circumference of the grinding chamber so that the grinding jets or rather their central axes intersect at one point. In a preferred invention design, three grinding nozzles (2) are spaced uniformly around the circumference of the grinding chamber, whose jets intersect at one point. When grinding materials, i.e. feed material of low bulk density, the grinding nozzles (2) are inserted in the grinding chamber such that they are flush with the wall. These grinding nozzles (2) are cylindrical grinding nozzles (2) which are operated at low grinding pressures. The feed material is supplied to the fluidised bed opposed jet mill (1) from below into the mill sump. This is the lowest point of the grinding chamber. The feed material is dosed to the fluidised bed opposed jet mill as a gas-particle mixture. A powder diaphragm pump (4) is preferably used for this task. To prevent the feed material from flooding through the grinding zone up to the classifying wheel (6) fitted above, a deflector hood (3) is installed above the feed point and below the recessed grinding nozzles, i.e. underneath the grinding zone. In a preferred invention design, the deflector hood is a circular plate fixed underneath the grinding zone. It is arranged perpendicularly to the direction of flow of the gas-particle mixture introduced into the fluidised bed and deflects or brakes the flow so that the feed material is deflected to the side and into the grinding zone.

If necessary, water can be injected into the grinding zone, to this end, water nozzles (5) are located between the grinding zone and the classifying zone. These nozzles are two-component nozzles (5) with which water and air is injected into the grinding zone in order to condition the grinding air and the material in the grinding zone. In a preferred invention design, the two-component water nozzle is located, when considered radially in the centre of the grinding chamber above the grinding zone and points towards the grinding zone.

The air classifier located above and at a distance from the grinding zone has a centrifugal-force classifying wheel (6) with vertical axis. The classifying wheel (6) has fittings located in the flow channels delimited by the classifying wheel vanes as described in patent DE 198 40 344 A1. The classifying wheel (6) has a large surface area with an L/D ratio of >1. To reduce the pressure drop, the classifying wheel has a fines discharge with large cross-section.

As can be seen in the Figure, the fluidized bed opposed jet mill (1) is charged by means of a powder diaphragm pump (4) with feed material out of supply bin (7) into the mill sump (12). Dosing is a function of the pressure drop. The grinding nozzles are supplied with compressed grinding gas, preferably compressed air from a compressor (8). The grinding is performed at temperatures which correspond to the outlet temperature of the gas at the gas-generating compressor.

In the case of these feed materials of low bulk density, preferred is a low-pressure grinding process. The grinding pressure is 3 bar (g). At pressures of up to 1 bar (g), rotary piston fans can be employed, whereas rotary piston compressors are used for pressures up to 1.5 bar (g). Over and above this, single-stage screw-type compressors are also used.

In order to improve the grinding process, the pressure drop across the system and especially the fluidised bed opposed jet mill (1) must be optimised. This can be done by setting a reduced grinding gas flow rate. In order to simultaneously reduce the spatter grain, the rinsing air flow rate at the classifying wheel gap between the classifying wheel and fines discharge is increased.

Subsequently to being mechanically stressed in the fluidised bed opposed jet mill (1), the product is separated from the air volume flow in the filter (9). Because a flow direction in the filter from below would substantially hinder the discharge of the comminuted product, the flow direction for the light and voluminous products is from top to bottom. A dedusting pressure that is as high as possible effectively prevents an increase of the pressure drop at the filter membranes and makes for a better discharge from the filter. The extremely voluminous product is discharged by means of a large double flap valve (10) with high cycle times. Downstream of the filter is a fan (11) which has the task of conveying the voluminous product and gas mixture through the system with the invention-design fluidised bed opposed jet mill as well as keeping the pressure inside the mill at a constant level and overcoming the pressure drop that develops at the classifying wheel caused by the product. The fan (11) is a one-stage fan with a high pressure rating.

REFERENCE NUMERAL LISTING

Fluidised bed opposed jet mill (1)
Grinding nozzles (2)
Deflector hood (3)
Powder diaphragm pump (4)
Water nozzles (5)
Two-component nozzles (5)
Centrifugal-force classifying wheel (6)
Classifying wheel (6)
Supply bin (7)
Compressor (8)
Filter (9)
Double flap valve (10)
Fan (11)
Sump (12)

The invention claimed is:

1. A fluidized bed opposed jet mill to produce for producing ultrafine particles from a feed material of low bulk density having a housing in vertical design, with a product feed point and a product discharge, with a grinding zone located in a lower area of the housing which has grinding nozzles spaced evenly around a circumference thereof, with jets of the grinding nozzles intersecting at one central point and with a classifying device installed in an upper area of the housing wherein the feed material is dosed as a gas-particle mixture from below into a sump of the fluidized bed opposed jet mill, whereby a deflector hood is fitted above the product feed point and below a level of the grinding nozzles, and the grinding nozzles are configured to be flush with a wall of the grinding zone.

2. The fluidized bed opposed jet mill of claim 1, wherein the classifying device has a horizontally arranged classifying wheel.

3. The fluidized bed opposed jet mill of claim 2, wherein the classifying wheel has fittings in flow channels and an L/D ratio of >1.

4. The fluidized bed opposed jet mill of claim 3, wherein the L/D ratio is between 1.2 and 1.3.

5. The fluidized bed opposed jet mill of claim 1, wherein the feed material is dosed by a powder diaphragm pump.

6. The fluidized bed opposed jet mill of claim 1, wherein the grinding nozzles are cylindrical.

7. The fluidized bed opposed jet mill of claim 1, wherein water nozzles configured to dose water are arranged above the grinding zone and below the classifying device.

8. The fluidized bed opposed jet mill of claim 1, further comprising a one-stage fan with a high pressure rating.

9. A process for producing ultrafine particles from a feed material of low bulk density using the fluidized bed opposed jet mill of claim 1 comprising:

dosing the feed material as a gas-particle mixture into the sump of the fluidized bed opposed jet mill underneath the grinding zone;

deflecting the feed material into the grinding zone using a deflector hood located above the product feed point and subjecting the feed material to mechanical stress in the grinding zone, thereby producing the ultrafine particles from the feed material of low bulk density.

10. The process of claim 9, further comprising injecting water into the fluidized bed opposed jet mill during the subjecting the feed material to mechanical stress.

11. The process of claim 9, wherein a rate at which the feed material is dosed is regulated as a function of a pressure drop between a grinding chamber and a filter of the fluidized bed opposed jet mill.

12. The process of claim 9, wherein pressure of a grinding gas for injecting into grinding nozzles of the fluidized bed opposed jet mill is equal to or less than 3 bar.

* * * * *